US005749610A

United States Patent [19]

Brammall et al.

[11] Patent Number: 5,749,610

[45] Date of Patent: May 12, 1998

[54] BOLT SEAL ASSEMBLY AND TOOL THEREFOR

[75] Inventors: Terrence N. Brammall, Angola; Randel Mills, Pleasant Lake; Rodney Ridenour, Fremont; David Stevenson, Angola, all of Ind.

[73] Assignee: Transguard Industries, Inc., Angola, Ind.

[21] Appl. No.: 618,132

[22] Filed: Mar. 19, 1996

[51] Int. Cl.[6] ..... E05B 39/02

[52] U.S. Cl. ..... 292/327; 292/318; 292/319

[58] Field of Search ..... 292/327, 318, 292/326, 319, 320, 313; 411/910; 24/136 R; 403/369

[56] References Cited

U.S. PATENT DOCUMENTS

| | | | |
|---|---|---|---|
| 3,762,027 | 10/1973 | Burtelson | 403/369 X |
| 3,868,748 | 3/1975 | Kelly | 24/115 M |
| 3,895,879 | 7/1975 | Burtelson | 403/369 |
| 3,975,040 | 8/1976 | Van Gompel | 292/318 |
| 4,418,952 | 12/1983 | Wallet | 292/327 |
| 4,626,009 | 12/1986 | Burnett et al. | 292/327 |
| 4,802,700 | 2/1989 | Stevenson et al. | 292/327 |
| 4,830,414 | 5/1989 | Davis | 292/327 |
| 5,127,687 | 7/1992 | Guiler | 292/327 |
| 5,347,689 | 9/1994 | Georgopoulos et al. | 24/136 R |
| 5,369,849 | 12/1994 | De France | 24/136 R |
| 5,413,393 | 5/1995 | Georgopoulos et al. | 292/327 |
| 5,450,657 | 9/1995 | Georgopoulos et al. | 24/136 R |

*Primary Examiner*—Rodney M. Lindsey
*Assistant Examiner*—Monica E. Millner
*Attorney, Agent, or Firm*—William Squire

[57] ABSTRACT

A steel bolt has weakening grooves at one end to which a head is swaged, the head having two frusto-conical portions at opposite ends. One end has a frusto-conical step for receiving a pair of jaws of a bolt breaking tool. A resilient spacer is attached to the bolt next to the head for limiting the depth of entry of the bolt head into a hasp hole, to provide access clearance for the tool and to permit the bolt to tilt to assist in breaking the bolt. The spacer is received in one hasp hole smaller in diameter than a second hasp hole to limit the depth of insertion of the spacer and the bolt head tapered end portion into the hasp. A seal with a conventional locking mechanism has a frusto-conical end region which partially engages the other hasp hole. The bolt and seal cooperate to lock the seal axially at different positions so the seal is engaged with one hasp hole and the bolt head engaged with the other hasp hole. A tool is disclosed which mates with the bolt head for breaking the bolt at the head when used with J-shaped hasps with limited tool receiving space.

21 Claims, 3 Drawing Sheets

BOLT SEAL ASSEMBLY AND TOOL THEREFOR

This invention relates to bolt seal assemblies, and more particularly, to bolt seal assemblies employing steel bolts with a bolt head at one end and a seal for locking attachment to the bolt other end for securing hasps and to tools for severing the bolt.

Bolt seals are typically used to seal the doors of railroad cars, trucks and the like. The seals comprise a steel cylindrical elongated bolt having an enlarged head at one end. A locking seal includes a hollow locking body with a locking mechanism which locks to the bolt when the bolt is inserted into the locking body.

A number of different variations of such bolt seals are commercially available. For example, commonly owned U.S. Pat. No. 4,802,700 discloses one type of bolt seal employing a straight steel rod with a screw or rivet type locking head at one end. The rod has a circumferential groove. The locking seal has a spring ring which engages a groove in the seal body and the rod groove for locking the rod in a fixed axial position relative to the seal. The rod free end is inserted through the opening of a hasp on a door, for example, with the head on one side of the hasp and the locking seal on the other side of the hasp. This secures the bolt seal to the hasp. To remove the locked seal from the hasp, a commercially available bolt cutter is used.

In other seal arrangements the bolt shaft may be bent so that one shaft portion is inclined relative to a second shaft portion with the head at one end and the seal being locked to the other end.

In some bolt seals the locking seal may be slid along the bolt shaft for locking to the bolt at different axial positions. See for example, commonly owned U.S. Pat. Nos. 5,413,393; 5,347,689 and 5,450,657. In U.S. Pat. Nos. 5,347,689 and 5,413,393, a rigid steel bolt shaft has annular grooves which are engaged by a mating collet in a cavity in the seal body. In U.S. Pat. No. 5,450,657, a flexible stranded wire cable is used instead of a rigid bolt shaft. A collet in the seal body cavity locks to the cable at any desired axial positon along the cable.

The above patents are representative of still other prior art bolt seals. In all of the above patents and in the prior art seals in general, the bolt heads are typically circular and comprise cylinders of various shapes or the rivet head type disclosed in U.S. Pat. No. 4,802,700. A cable cutter is used to break the seal of U.S. Pat. No. 5,450,657. The bolts of U.S. Pat. Nos. 5,413,393 and 5,347,689 have weakening serrations at the bolt head so that the head and bolt when bent will sever the head and swaged bolt portion from the rest of the bolt. This is shown in particular in U.S. Pat. No. 5,413,393. In certain of the above patents by permitting the seal to slide along the bolt, the seal and bolt head may abut against the hasp to preclude breaking the seal with a bolt cutter. U.S. Pat. No. 5,413,393 is provided with a spacer to provide room for a bending tool for use by an authorized user. However, the spacer is thermoplastic and might break due to tampering. Also, a tamperer may use a bolt cutter to cut the bolt.

The authorized tool for breaking the bolt is typically a circular cylinder as illustrated in U.S. Pat. No. 5,413,393. To break the bolt, the bolt head is inserted in a slot in the tool head and the shaft of the tool is pulled toward the user. In the above patents and in the prior art, a disadvantage as recognized by the present inventors is that access to the bolt with a bolt cutter can defeat the seal. More importantly, even in those bolt seals with weakening grooves, the bolt shaft is exposed for access by a bolt cutter without the necessary bolt breaking tool. In those patents where the seal and bolt head tightly engage the hasp, the bolt heads are difficult to remove because of poor bolt bending leverage for the user as discussed below.

A further problem is that in the prior art bolt seals, the bolt shaft is typically transversely rigid in the hasp opening. That is, the shaft has little or no transverse play in the hasp opening. For example, U.S. Pat. No. 5,413,393, a thermoplastic spacer provides clearance for a bolt breaking tool to grasp the bolt head. Others of the prior art seal and bolt assemblies provide loose axial engagement of the bolt and head to the hasp to permit clearance for attachment of the seal breaking tool to the bolt head. This allows a tamperer to access the bolt with a bolt cutter.

Conventional bolt bending tools are difficult to use with transversely rigid bolts because the bending of the bolts by an authorized tool may also pull on the bolt in tension rather than impose the desired bending moment on the bolt. To manually pull on a steel bolt in tension is difficult. Also, the bolt heads tend to vary in shape and configuration for many seal assemblies, requiring a number of different bolt head and mating tool configurations.

A further problem is that some hasps may have a J-shape forming a tamper resistant channel in which the hasp opening is at the base of the channel. Such a channel is generally too narrow for conventional tools such as the type illustrated in the aforementioned U.S. Pat. No. 5,413,393. Seals and tools for use with such hasps need to be of special configuration. It is costly to provide special bolts and tools of different designs for each different application.

A further problem with prior art bolt seals is that tamperers place a pipe over the end of the bolt or bolt head and bend the bolt until it breaks. Certain seals of the prior art deal with this problem by causing the seal and bolt head to abut tightly against the hasp. This leaves little room for the grasping the bolt head with a tool for authorized users of such a tool.

The present inventors recognize a need for a universal tool and bolt head for use with a bolt of a seal assembly that is easily bent with a minimum pulling on the bolt in tension during breaking of the bolt and that will resolve all of the above problems with a simple arrangement.

A bolt seal assembly for attachment to a hasp having a bolt receiving aperture according to the present invention comprises an elongated bolt having a longitudinal axis and opposing ends, the bolt for passing through the aperture. A bolt head is included having proximal and distal ends, the head being secured to one end of the bolt, the head proximal end being dimensioned to be received in the aperture, the head distal end having at least a portion enlarged relative to the aperture to preclude being received in the aperture. A seal is provided for locking attachment to the bolt to lock the bolt to the hasp, the seal having proximal and distal ends, the seal proximal end being dimensioned to be received in the aperture, the seal distal end being enlarged relative to the aperture to preclude being received in the aperture, the seal and bolt including means arranged to permit the seal to be axially displaced and locked to the bolt in a range of longitudinal axial positions to cause the head and seal proximal ends to engage the aperture in opposing relation while permitting transverse displacement of the bolt head relative to the hasp. Thus the bolt is not exposed for cutting with a bolt cutter between the seal and the bolt head.

In one embodiment, a resilient member is attached medially to the bolt and dimensioned to be received in the hasp aperture to provide resilient engagement of the bolt with the hasp in a direction transverse the bolt longitudinal axis. This permits transverse displacement of the bolt to minimize tension on the bolt during breaking.

In a further embodiment, the hasp aperture has a transverse dimension which narrows in a depth direction, the member being dimensioned relative to the hasp aperture transverse dimension to limit the depth of axial engagement of the bolt head in the aperture in the depth direction. This precludes axial locking of the seal and bolt head tightly against the hasp.

In a further embodiment, the bolt includes weakening means at the head to permit the head to be severed from the bolt in response to a transverse bolt bending force imposed on the head.

In a still further embodiment, the head and the seal each have a tapered region at the proximal ends which narrows transversely in a direction toward each other, the tapered regions for engagement with the hasp aperture.

In a further embodiment, the tapered region of the head and the seal are each frusto-conical.

A tool for manually severing the bolt head from the bolt comprises a handle extending along a second axis and a bolt head grasping head portion secured to the handle, the head portion having a cavity for receiving the bolt head and a pair of opposing spaced jaws in the cavity for grasping and bending the bolt in a region thereof at the head in response to a torque on the handle, the jaws defining a third axis, the tool head portion having a width transverse the third axis of about the same extent as the bolt head enlarged portion in a direction transverse the longitudinal axis.

In one embodiment of the tool, the cavity is generally cross shaped when viewed transversely the third axis, the tool head having two pairs of spaced bolt head grasping jaws forming a portion of the cavity.

In a further embodiment, the tool includes means arranged such that the third axis is aligned with the bolt longitudinal axis when the bolt head is received between the jaws, the handle lying on a second axis inclined relative to the first and third axes.

IN THE DRAWING

Figure 1:
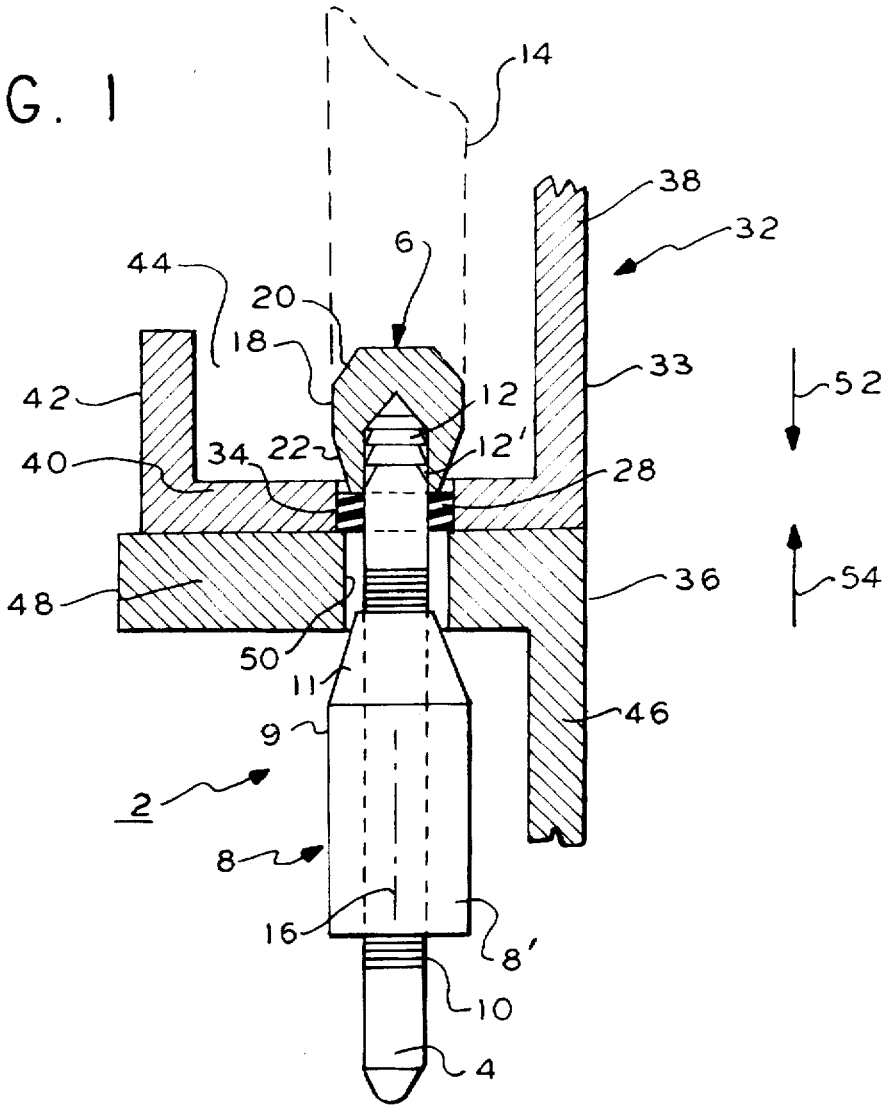
FIG. 1 is a fragmented partially in section elevation view of a seal assembly according to one embodiment of the present invention.

In FIG. 1, seal assembly 2 comprises a steel bolt 4, a steel head 6 and a steel seal 8, all of which may be standard non-hardened or hardened steel. The bolt 4 is a circular cylindrical shaft having a longitudinally extending array of annular grooves 10. A longitudinally extending array of annular weakening serrations or grooves 12 are at the head end of the bolt 4. Groove 12' is of greater depth than the remaining grooves 12. This greater depth is to insure that the bolt 4 breaks at groove 12' when subject to bending stress via head 6. The bending stress is induced by tool 14 when rotated in direction 16 (FIG. 4) as will be explained more fully below. Direction 16 is in a plane normal to the drawing sheet of FIG. 1.

The seal 8 may have an internal locking mechanism of any conventional design and preferably may be as described in the aforementioned patents, and particularly, U.S. Pat. Nos. 5,413,393, 5,347,689 or 5,450,657, all incorporated by reference herein. The last mentioned patent is directed to a stranded cable type bolt to which the principles of the present invention are applicable.

Generally, the seal 8 comprises a body 8' having a tapered frusto-conical cavity (not shown) in which is a collet (not shown) which slides along the bolt 4 in the body 8' cavity. See the aforementioned patents for more specific description of different collet structures. The collet may have radially resilient fingers (not shown) and may be frusto-conical for mating with the cavity. The collet fingers have teeth which radially selectively engage any of the grooves 10. The collet wedges against the smaller diameter end of the body 8' cavity for wedging against and locking to the bolt. This permits the seal 8 to be axially locked to the bolt 4 at a convenient location along the longitudinal axis 16 of the bolt.

The seal 8 body 8' has a circular cylindrical portion 9 and a preferably frusto-conical tapered portion 11. The portion 11 engages the hasp 32 and is unique for seals of this type and its purpose will be described below.

Head 6 is circular with a circular cylindrical medial portion 18, a frusto-conical distal portion 20 and a frusto-conical proximal portion 22. Portion 22 has an annular frusto-conical step 22', FIG. 2*a*. In FIG. 2*a*, portions 22 and 22' are spaced by an axially extending shoulder 23 which preferably extends axially parallel to axis 16 distance d about 0.010 inches (0.25 mm). The shoulder 23 radially inwardly offsets slightly the conical surface of the portion 22' from the conical surface of portion 22 as shown in FIG. 2*a*. The conical surface of portion 22 is inclined relative to axis 16 preferably about 20°. The portion 22' surface is preferably inclined about 110.5° with the normal to axis 16. Portion 22' is thus indented radially inwardly relative to portion 22 for receiving and engaging certain of the jaws of the bolt breaking tool 14 (FIG. 4) as will be explained below. The cylindrical portion 18 lies in the axial range of about 0.40 to 0.648 inches (10 to 35 mm) from the narrow diameter proximal end edge 26 of the portion 22.

The head 6 has a bore 24 for closely receiving the bolt 4 at weakening grooves 12, 12', the bolt 4 having a diameter preferably of about 0.375 inches (9.5 mm). The head 6 is swaged attached to the received bolt in a conventional manner. Head 6 by way of example may have a maximum diameter of 0.750 inches (19 mm) at cylindrical portion 18, an axial length along axis 16 of about 0.850 inches (22 mm) with the frusto-conical portion 22 having an axial length of about 0.263 inches (about 7 mm), a circular cylindrical portion 18 with an axial length of about 0.250 inches (6.4 mm), and the frusto-conical portion with an wall extent of about 0.2 inches (5 mm). the dimensions of the head are important for providing a universal head that can be used with a wide variety of hasp dimensions and configurations.

Figure 3:
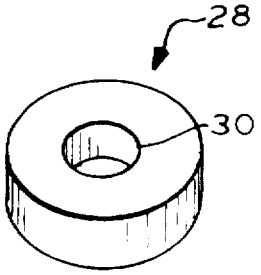
FIG. 3 is an isometric view of a resilient washer used in the embodiment of FIG. 1.

A elastomeric, preferably rubber or similar resilient material, washer-like spacer 28, FIG. 3, has a central circular cylindrical hole 30 dimensioned so that the spacer 28 closely receives the bolt 4 shank, FIG. 1. The spacer 28 has an outer diametrical dimension that is closely received in or in interference fit with the hasp 32 member 33 in hasp member 33 hole 34. The spacer 28 may for example be ¼ inch thick (6.4 mm) and ¾ inch (19 mm) in outer diameter with a ⅜ inch (9.5 mm) diameter hole 30. The spacer 28 is positioned on the bolt 4 shank adjacent to the head 6.

The hasp 32 comprises two hasp members 33 and 36. Not shown in FIG. 1 are the doors and so to which the hasp 32 is attached. For example, the hasp member 36 may be fixedly attached to one door and the hasp member 33 may be rotationally or fixedly attached to a second door. The hasp members 33 and 36 are metal, e.g., steel, as typical for commercially available hasps. Hasp member 33 is J-shaped having a side wall 38 next adjacent to a door (not shown), a bottom wall 40 having hasp hole 34 and an outer upstanding lip 42.

Member 33 forms a rectangular channel 44 which extends along the side of the not shown door into the plane of the drawing FIG. 1. The hole 34 is located centrally or offset in the channel 44 approximately medially in the wall 40 between the lip 42 and wall 38. The transverse width of the channel 44 from left to right in FIG. 1 provides insufficient room for prior art tools to access a prior art bolt head used in prior art seal assemblies.

Member 36 is L-shaped and includes a side wall 46 and a base wall 48. Member 36 base wall 48 has a hole 50. Hole 50 is aligned with hole 34 when the hasp members are aligned with the doors closed. Hole 50 is larger in diameter than hole 34.

In attaching and locking the seal assembly 2 to the hasp 32, the seal 8 is separate from the bolt 4. The bolt 4 with the head 6 attached is inserted in the direction 52 into the hasp member holes 34 and 50. The spacer 28 is inserted into the hole 34 until it abuts against the hasp member 36 as shown in FIG. 1. This axially locks the spacer 28 in direction 52. The spacer 28 has a thickness such as to provide a limit on the depth of penetration of the bolt head 6 into the hole 34. The narrow proximal end edge 26 of the head 6 is permitted by the spacer thickness to enter into the hole 34 somewhat. Thus the bolt 4 shank is not exposed in the region above the hasp member 33 wall 40 in channel 44.

The seal 8 is then attached to the bolt 4 shank as shown in FIG. 1. The seal 8 is slid along the shank with the collet (not shown) engaging the grooves 10. As the seal is displaced in direction 54 along the bolt shank, the seal is irreversibly locked to the bolt in the axial position in direction 54. The seal 8 is then slid further until the narrow end of frusto-conical end portion 11 of the seal body 8' enters and engages the hole 50 of the hasp member 36, the hole 50 being larger in diameter than the narrowest end diameter of the portion 11.

The seal body 8' may be inserted into the hole 50 until the body is fully seated in the hole 50, but this is not necessary as long as the tapered narrow body end is within the hole 50. This seal position within the hole 50 precludes access to the bolt 4 by a bolt cutter between the seal 8 and the hasp member 36 and between the head 6 and the hasp member wall 40, the head 6 being engaged within the hole 34. The bolt head in the hasp member 33 hole 34 precludes access by a bolt cutter to the bolt between the head 6 and the hasp member 33. This is important to preclude cutting the bolt by unauthorized tamperers who do not have the necessary tool 14 for breaking the seal.

The head 6 is within the channel 44 which precludes access to the head with prior art seal breaking tools. During attachment of the seal 8 to the bolt, the tendency of a user is to tightly engage the seal 8 against the hasp member 36 and the head 6 against the spacer 28. Unlike prior art seal assemblies, this does not present a problem in removing and breaking the head 6 end of the bolt 4 with the tool 14.

The spacer 28 insures that the 6 head has a clearance with the wall 40, which clearance is also provided by the tapered configuration of the frusto-conical portions 22 and 22'. Also, the spacer 28 spaces the head 6 cylindrical portion 18 sufficiently above the bottom wall 40 to permit the head 6 to be accessed and engaged by tool 14 as illustrated. This is important, because if the head were not spaced above the member 33 wall 40 sufficiently, the tool 14 could not engage the head 6 and operate to break the bolt 4 shank.

Figure 4:
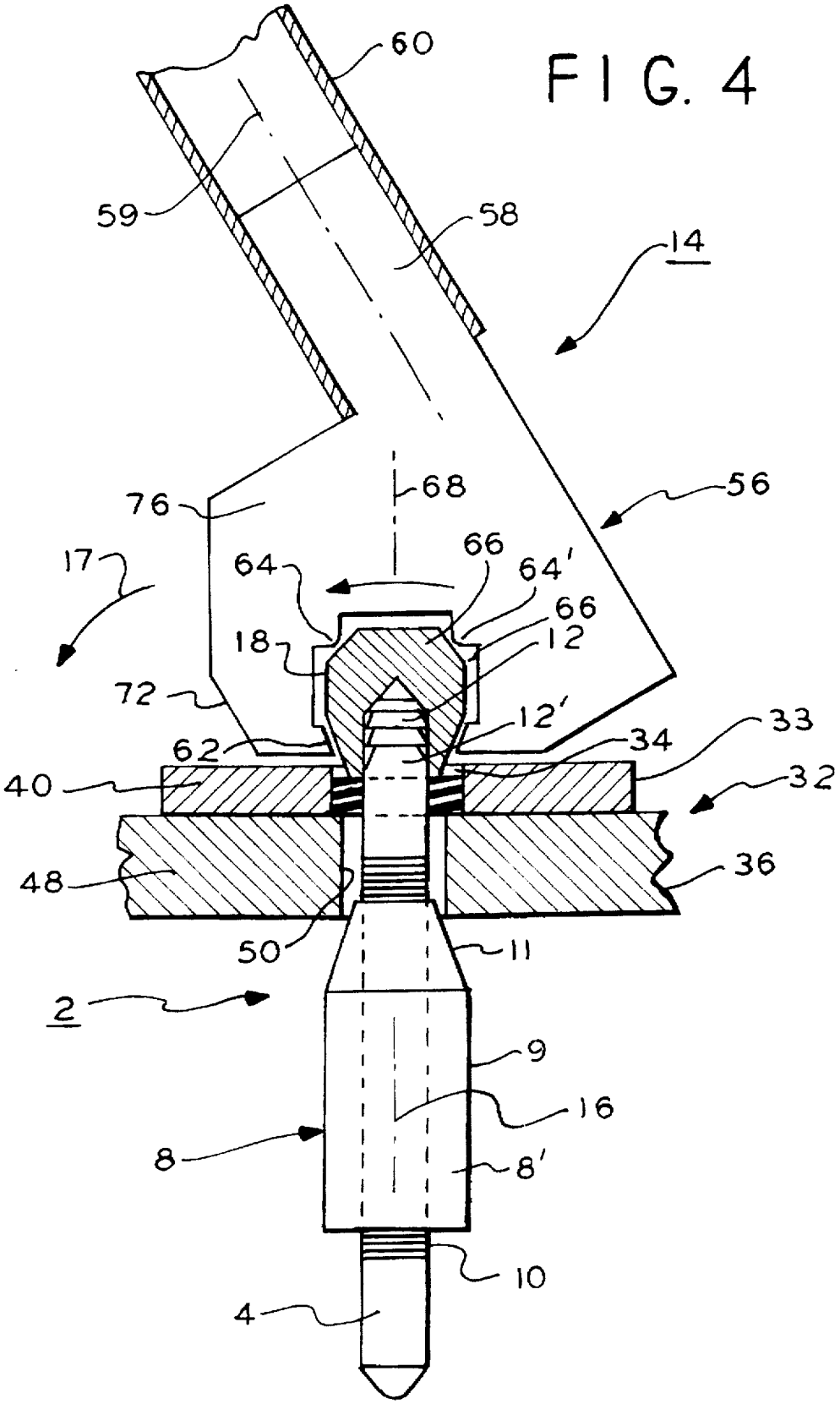
FIG. 4 is a front fragmented partially in section elevation view of a seal assembly and tool for breaking the seal according to the present invention.
Figure 5:
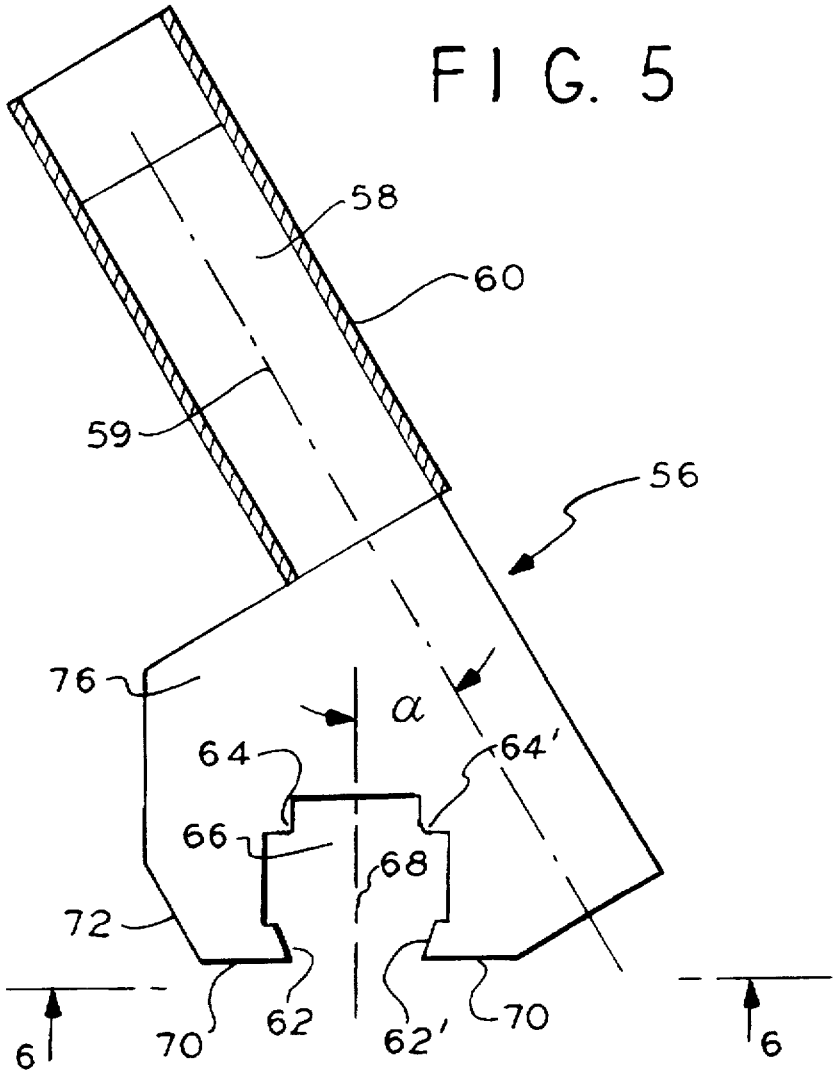
FIG. 5 is a front elevation view of the tool head of FIG. 4.
Figure 6:
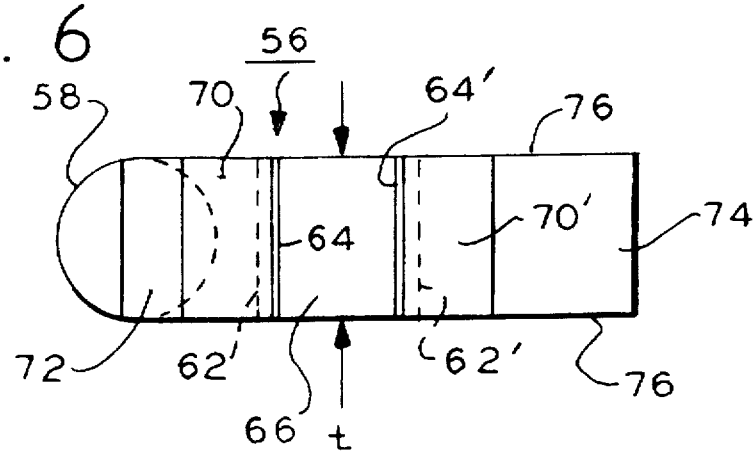
FIG. 6 is a bottom plan view of the tool head of FIG. 5 taken along lines 6—6.

The tool 14, FIGS. 5 and 6, comprises a preferably steel head 56 including a circular cylindrical handle receiving member 58 lying on axis 59. The member 58 is attached to a pipe 60 for providing leverage to the tool 14 for breaking the bolt 4, FIG. 4. The head 56 has a pair of bolt head 6 grasping jaws 62, 62' and 64, 64'. Jaws 62 and 62' are mirror images as are jaws 64, 64'. The jaws are in a cavity 66 and form the cavity 66 into a generally cross shape in a direction normal to axis 68 and the plane of the sheet of FIG. 5. Axis 68 and 59 are preferably inclined at an angle α, e.g., 30°.

Figure 2:
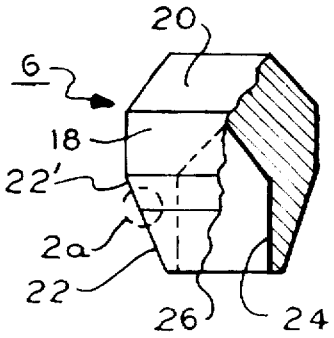
FIG. 2 is a side elevation view partially in section of the FIG. 2*a* is a more detailed view of the head of FIG. 2 taken in region 2*a*; bolt head in the embodiment of FIG. 1.
Figure 2A:
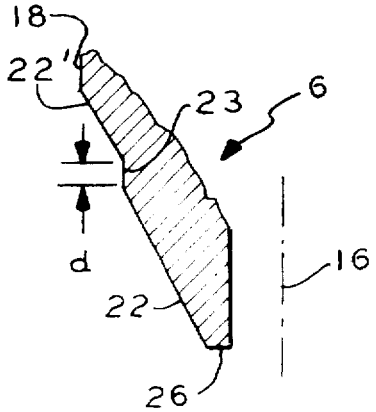

Jaws 62, 62' are inclined generally at about the same angle of inclination as the head 6 step frusto-conical portion 22', FIG. 2*a* and the jaws 64, 64' are inclined generally at about the same angle of inclination as the head 6 portion 20, FIG. 2. The cylindrical head 6 portion 18 is received in the cavity 66 between the jaws 64, 64' and 62, 62' as shown in FIG. 4. The surfaces of jaws 64, 64' may comprise a chamfered surface. The jaws 62, 62' are dimensioned to fit within the step region of the head 6 portion 22'.

The jaws 62, 62' each have coplanar surfaces 70, 70', which abut against the surface of hasps member 33 wall 40, FIG. 4. Axis 68 at this time is approximately coaxial with the bolt axis 16. The tool head 56 has an inclined surface 72 that intersects the surface 70 and an inclined surface 74 that intersects the surface 70', surface 74 being normal to axis 59. The angle of inclination of the surface 72 to the plane of surface 70 is preferably about 60° and the angle of surface 74 to surface 70' is preferably about 30°.

The jaws 62, 62' may have their narrowest spaced apart gap at surfaces 70, 70' of preferably about 0.605 inches (15 mm) for use with the head 6 as dimensioned above herein. The latter jaws also may preferably be about 0.165 inches in thickness in a direction parallel to the axis 68. The head 56 has a thickness t, FIG. 6, preferably of about 0.750 inches. This thickness is important because it permits the head 56 to be positioned between the bolt head 6 and the hasp lip 42 for attaching the head 56 to the bolt head as shown in phantom, FIG. 1. The tool is placed alongside the bolt head in the channel 44 and then slid toward the bolt head to engage the bolt head in the tool head 56 cavity 66. The tool head 56 has opposing broad planar surfaces 76. Thus the tool head 56 presents a rectangular section transverse and normal to the axes 59 and 68. The dimensions of the jaws 62, 62' with respect to surfaces 72 and 74 is sufficient to provide a relatively strong set of jaws for breaking the bolt shank at the weakening groove 12', FIG. 1. The jaws 62, 62' are sufficiently compact to fit within the confines of the reduced spaces of hasp member 33 between wall 38, FIG. 1 and lip 42 and between the bolt head 6 and the lip 42.

In operation, the locked seal assembly 2 is adjusted so that the bolt head 6 abuts the spacer 28, FIG. 1. This spaces the head 6 within the hasp hole 34 and also spaces the frusto-conical portion 20' sufficiently above the hasp wall 40 to receive and engage the tool 14 jaws 62, 62' in the step portion 22', FIG. 2. The tool is then rotated parallel to the doors (not shown), FIG. 4, in the direction 17.

This rotation of the tool engages the jaw 62 edge with the shoulder 23, FIG. 2*a*, of the head 6, assisting in the bending of the bolt 4 shank at the weakening groove 12' via the other jaw 62', which lifts the head 6 in a tilting direction. The spacer 28 is resilient and permits this tilting action by permitting the bolt 4 to tilt in the hole 34 of the hasp member 33 and hole 50 of hasp member 36. This is important as without tilting the bolt, the head may require pulling in tension which is difficult manually. Prior art implementations where the bolt can not tilt in place are difficult to break with a bending tool for this reason.

Because the spacer 28 is resilient, a tamperer can not break the spacer in an attempt to bend and break the bolt without the tool 14. A tamperer by tilting the bolt merely resiliently moves the bolt in the spacer 28 without damage to the spacer. The rotation of the tool is in a plane that is normal to the plane of rotation of the prior art tools, which is usually toward the user. The tool 14 in contrast is rotated in a plane across the front of the user.

The tool 14 and the head 6 are universal in that they will fit most hasps whether or not they are of the J-shape illustrated in FIG. 1. The head 6 may be used with any type of bolt or shank of a given implementation. Also, because the seal 8 and the head 6 both engage the hasp holes, a tamper is unable to access the bolt shank to use a bolt cutter, thus requiring the use of the tool 14. The tool 14 can be used on the head 6 regardless a particular seal or bolt implementation employed therewith. That is, the seal body 8', FIG. 1 may not necessarily have the tapered end portion 11 as in the prior art seals in order to use the tool and head of the present invention therewith. However, it should be appreciated that a tapered seal body as described herein with portion 11 is preferable.

It will occur to those of ordinary skill that modifications may be made to the disclosed embodiments. It is intended that the scope of the invention be defined by the appended claims and not by the specific description given herein which is given by way of illustration and not limitation.

What is claimed is:

1. A bolt seal assembly for attachment to a hasp having a bolt receiving aperture comprising:

an elongated bolt having a longitudinal axis and opposing ends, said bolt for passing through the aperture;

a bolt head having proximal and distal ends, said head being secured to one end of the bolt, the head proximal end being dimensioned to be received in said aperture, the head distal end having at least a portion enlarged relative to said aperture to preclude being received in the aperture; and a seal for locking attachment to the bolt for locking the bolt to the hasp, said seal having proximal and distal ends, said seal proximal end for being received in said aperture, said seal distal end being enlarged relative to said aperture to preclude being received in the aperture, said seal and bolt including means arranged to permit the seal to be axially displaced and locked to the bolt in a range of longitudinal axial positions for causing said head and seal proximal ends to engage said aperture in opposing relation while permitting transverse displacement of the bolt relative to the hasp.

2. The assembly of claim 1 including a resilient member attached medially to the bolt for attachment in said aperture and for permitting relative radial displacement of the bolt to the hasp in a direction transverse the bolt longitudinal axis.

3. The assembly of claim 2 wherein the bolt includes weakening means at said head to permit the head to be severed from the bolt in response to a transverse bolt bending force imposed on the head.

4. The assembly of claim 1 wherein said head and said seal each have a tapered region at said proximal ends which narrows transversely in a direction toward each other for engagement with the hasp aperture.

5. The assembly of claim 4 wherein said tapered region of said head and said seal are each frusto-conical.

6. The assembly of claim 1 wherein the bolt includes an array of annular grooves extending along said axis for locking engagement with said seal.

7. The assembly of claim 1 including means for limiting the axial depth of engagement of one of the head and seal with the hasp aperture to permit transverse relative displacement of the locked bolt to the hasp.

8. The assembly of claim 2 wherein said hasp aperture has a transverse dimension which narrows in a depth direction, said resilient member being dimensioned relative to said hasp aperture transverse dimension to limit the depth of axial engagement of the bolt head in said aperture in said depth direction.

9. The assembly of claim 1 wherein said head has a cylindrical medial portion extending about said axis and a frusto-conical end portion having a narrowing transverse diameter extending from said medial portion toward said distal head end for engagement with the hasp aperture.

10. The seal assembly of claim 1 including means for limiting axial displacement of the head into said aperture while permitting transverse displacement of the head relative to said hasp while engaged with said aperture.

11. The seal assembly of claim 1 wherein said head proximal end is dimensioned transverse said axis relative to said aperture a magnitude value relative to said aperture for permitting transverse displacement of the bolt and head at said head end of the bolt while the head proximal end is engaged in said aperture in the locked state.

12. The seal assembly of claim 3 further including a tool for releaseably engaging the head for manually imparting said transverse bending force.

13. The seal assembly of claim 12 wherein the hasp is J-shaped forming a channel for receiving the head, said channel including a bottom wall and extending in a given direction, said aperture being in said bottom wall, said tool having a width and being dimensioned to fit in said channel and for imparting said bending force in a plane parallel to said channel.

14. A combination including a bolt seal arrangement and a hasp having a bolt receiving aperture of a given diameter, the bolt seal arrangement of the combination comprising:

an elongated bolt having a longitudinal axis and opposing ends, said bolt for passing through the aperture, said bolt having weakening means at one end;

a bolt head having proximal and distal ends, said head being secured to said one bolt end, the head proximal end having a frusto-conical surface that tapers toward a smaller diameter in a direction away from the distal end, at least a portion of the tapered surface for being received in said aperture, the head tapering to a diameter greater than the aperture given diameter in a direction toward said distal end to preclude being received in the aperture; and a seal including means for locking attachment to the bolt in a range of axial positions along the bolt to lock the bolt to the hasp, said seal having a proximal end and a distal end, said proximal end being frusto-conical and tapering toward a reduced diameter in a direction away from said seal distal end for engagement in said aperture, said distal end being enlarged transverse said axis relative to said aperture given diameter to preclude being received in the aperture.

15. The seal arrangement of claim 14 further including a tool for severing said head at said weakening means by manually bending the bolt at said head, said tool including a pair of opposed spaced jaws defining a space therebetween for engaging said head frusto-conical proximal end and a relatively enlarged central cavity for receiving said head greater diameter.

16. The seal arrangement of claim 15 wherein the tool has a bolt head engaging head portion and a handle portion, said jaws being located in said head portion, said head portion being rectangular in transverse section with opposing broad flat surfaces, said cavity and the space between the jaws being in communication with said flat surfaces.

17. The seal arrangement of claim 15 wherein said bolt head includes a cylindrical central portion and the distal end includes a further frusto-conical portion tapering toward a smaller diameter from said cylindrical portion in a direction away from said proximal end, said tool jaws comprising a first set of opposing spaced bolt head engaging jaw surfaces each inclined to mate with said head proximal end frusto-conical surface, an enlarged central cavity region interior said head engaging jaw surfaces for receiving said cylindrical portion and a second set of opposing spaced bolt head engaging jaw surfaces each inclined to mate with said distal head end further frusto-conical surface.

18. The seal arrangement of claim 17 wherein the cylindrical portion is circular and the tool head portion has a transverse width of about the same dimension as the diameter of said bolt head cylindrical portion.

19. A tool for manually severing the bolt head from the bolt of claim 3, said tool comprising:

a handle extending along a second axis; and a bolt head grasping head portion secured to the handle, said head portion having a cavity for receiving said bolt head and a pair of opposing spaced jaws in said cavity for grasping and bending the bolt in a region thereof at said head in response to a torque on said handle, said jaws defining a third axis, said tool head portion having a width transverse the third axis of about the same extent as said bolt head enlarged portion in a direction transverse the longitudinal axis.

20. The tool of claim 19 wherein said cavity is generally cross shaped when viewed transversely said third axis, said tool head having two pairs of spaced bolt head grasping jaws forming a portion of said cavity.

21. The tool of claim 20 wherein the tool includes means arranged so that said third axis is aligned with the bolt longitudinal axis when the bolt head is received between the jaws, the handle lying on a second axis inclined relative to the first and third axes.

* * * * *